United States Patent [19]

Hey

[11] Patent Number: 4,633,799

[45] Date of Patent: Jan. 6, 1987

[54] CARGO CARRIER

[75] Inventor: Heinz-Herbert Hey, Henstedt-Ulzburg, Fed. Rep. of Germany

[73] Assignee: C.E.M.A.N. Special-Container GmbH, Hamburg, Fed. Rep. of Germany

[21] Appl. No.: 778,152

[22] Filed: Sep. 13, 1985

Related U.S. Application Data

[63] Continuation of Ser. No. 351,545, Feb. 23, 1982, abandoned.

[30] Foreign Application Priority Data

Feb. 24, 1981 [DE] Fed. Rep. of Germany ..... 3106751

[51] Int. Cl.[4] ..... B63B 25/24

[52] U.S. Cl. ..... 114/72; 16/236; 114/75; 410/129

[58] Field of Search ..... 114/72, 75, 248; 410/68, 71, 77, 78, 121, 122, 129, 131–135, 140, 141, 142; 105/370, 371, 372, 374; 16/366, 235–237, 242

[56] References Cited

U.S. PATENT DOCUMENTS

| | | | |
|---|---|---|---|
| 2,720,857 | 10/1955 | Rosamond et al. | 114/78 |
| 2,725,589 | 12/1955 | Papesh | 16/236 |
| 3,352,257 | 11/1967 | Lehnert et al. | 410/134 |
| 3,463,110 | 8/1969 | Oshima | 114/75 |
| 3,583,350 | 6/1971 | Goldman | 114/72 |
| 3,680,518 | 8/1972 | Tabuchi et al. | 410/71 |
| 3,799,101 | 3/1974 | Finefrock | 114/248 |

*Primary Examiner*—Sherman D. Basinger
*Attorney, Agent, or Firm*—Peter K. Kontler

[57] ABSTRACT

A cargo compartment of a cargo carrier is bounded by a pair of generally vertical walls which extend in the longitudinal direction of the cargo carrier. At least two pairs of confining members are pivotally mounted on these walls for movement between operative and inoperative positions. In the inoperative positions, the confining members are generally parallel to the walls of the cargo compartment and the latter is capable of accommodating bulk goods. In the operative positions, the cargo compartment is capable of receiving containers and the confining members of each pair extend generally normal to the longitudinal axis of the cargo carrier and are in alignment with one another. The two pairs of confining members may be spaced from one another by several container lengths in their operative positions. In such an event, dividers which extend parallel to the confining members may be arranged between the latter in such a manner that the distance between each pair of confining members and the neighboring divider, as well as the distance between neighboring dividers, equals one container length. The dividers are releasably secured to the walls of the cargo compartment.

4 Claims, 10 Drawing Figures

CARGO CARRIER

This application is a continuation of application Ser. No. 351,545, filed Feb. 23, 1982, and now abandoned.

BACKGROUND OF THE INVENTION

The invention relates generally to a cargo carrier, especially an oceangoing cargo vessel.

More particularly, the invention relates to a system for storing containers in the cargo compartment of a cargo carrier.

A known system for storing containers in the hull of a ship employs confining members which are constituted by crisscrossing horizontal and vertical bars. The horizontal bars, which are connected to one another by the vertical bars, extend transversely of the longitudinal axis of the ship.

Such a system has proved itself in practice. However, it has been found that the time required to install the confining members is excessive. Furthermore, when the confining members are removed and stored in order to convert the cargo compartment for the transportation of bulk goods, it is difficult to subsequently reinstall the confining members. Moreover, since the confining members are stored below deck in the region of the walls of the cargo compartment when not in use, it is possible for the bulk goods in the cargo compartment to press against the confining members. The pressure exerted on the confining members can be sufficiently great to deform the latter so that they can no longer be used. In order to avoid this, it is necessary to store the confining members with great care when the cargo compartment is converted for the transportation of the bulk goods. This, however, is time-consuming and therefore expensive.

OBJECTS AND SUMMARY OF THE INVENTION

It is an object of the invention to provide a system for storing containers in a cargo carrier which is capable of being set up relatively rapidly.

Another object of the invention is to provide a system for storing containers in a cargo carrier which can be set up with relative ease.

An additional object of the invention is to provide a system for storing containers in a cargo carrier which is capable of being brought into and removed from storage relatively simply and quickly.

A concomitant object of the invention is to provide a confining member of the type described above which is designed in such a manner that the entire storage system may be manipulated rapidly and reliably regardless of whether the cargo compartment is to be set up for the transportation of containers or for the transportation of bulk goods.

The preceding objects, and others which will become apparent as the description proceeds, are achieved by the invention.

One aspect of the invention resides in the provision of a cargo carrier, particularly an oceangoing cargo vessel, which comprises means defining a cargo compartment and including at least one wall. A confining member is provided for confining containers which are accommodated in the compartment. The confining member is mounted on the wall for movement between an operative position in which it is arranged to confine containers and an inoperative position in the region of the wall.

It is preferrred for the confining member to be pivotally mounted on the wall.

The movable confining member provides several advantages. It strengthens the entire storage system when it is moved to its operative position so that the containers are firmly held against displacement in both the longitudinal and transverse directions of the storage compartment. Furthermore, the confining member may be mounted in such a manner that it parallels the wall of the compartment in its inoperative position and cooperates with the wall to define a storage space in which all loose parts of the storage system may be stored.

According to one embodiment of the invention, the confining member includes horizontal bars which extend transversely of the storage compartment in the operative position and vertical bars which crisscross the horizontal bars and connect the latter with one another. The confining member may further include reinforcing plates which cover the openings in the network defined by the crisscrossing horizontal and vertical bars and abut one another so that the confining member is virtually free of openings. Among other reasons, this design is advantageous since it enables the infiltration of dust into the storage space between the confining member and the wall of the compartment to be prevented and is capable of reliably preventing bulk goods carried in the cargo compartment from entering the storage space.

The reinforcing plates of the confining member may themselves be reinforced by means of reinforcing elements which extend over the entire height of the confining member. Such reinforcing elements insure that the confining member remains undamaged even when subjected to relatively high pressures by bulk goods carried in the cargo compartment.

Another confining member may be mounted on the compartment wall for movement between operative and inoperative positions. The confining members may cooperate in their operative positions to confine containers between them.

In accordance with another embodiment of the invention, it is possible to confine rows of containers each of which consists of three containers laid end-to-end with a single pair of movable confining members. Here, the confining members are separated by three container lengths and a pair of dividers is located between the confining members. The dividers are spaced from one another by one container length and each of the dividers is likewise spaced from a respective confining member by one container length. The dividers are releasably connected with the wall of the cargo compartment.

Both confining members may cooperate with the compartment wall in the inoperative positions thereof to define a storage space. The storage space may be made large enough to accommodate the dividers once these have been disconnected from the compartment wall and, in fact, sufficiently large that the confining members may be arrange parallel to the compartment wall without difficulty even when the dividers are accommodated in the storage space.

In accordance with an advantageous embodiment of the invention, each of the confining members is pivotally mounted on a plurality of vertical spaced hinges which are supported by a longitudinally extending wall of the cargo compartment. The hinges are spaced from one another by no more than the distance between neighboring ones of the horizontal bars constituting part of the confining member. The hinges may be designed in such a manner as to permit a certain amount of movement of the confining member in the longitudinal direction of the compartment. The confining member may be easily pivoted on the hinges without the danger that it will tip and fall under its own weight. The confining member may be moved with the aid of a lift truck which is capable of lifting the confining member and subsequently readily rotating the same. It is also possible to provide for simple and reliable rotation of the confining member by mounting the latter on rollers or wheels.

The cargo compartment and the confining member or members may have cooperating arresting elements via which the confining member or members are locked in their operative positions. It is then necessary to release the confining member or members before these are moved to their inoperative positions.

The novel features which are considered as characteristic of the invention are set forth in particular in the appended claims. The improved cargo carrier itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
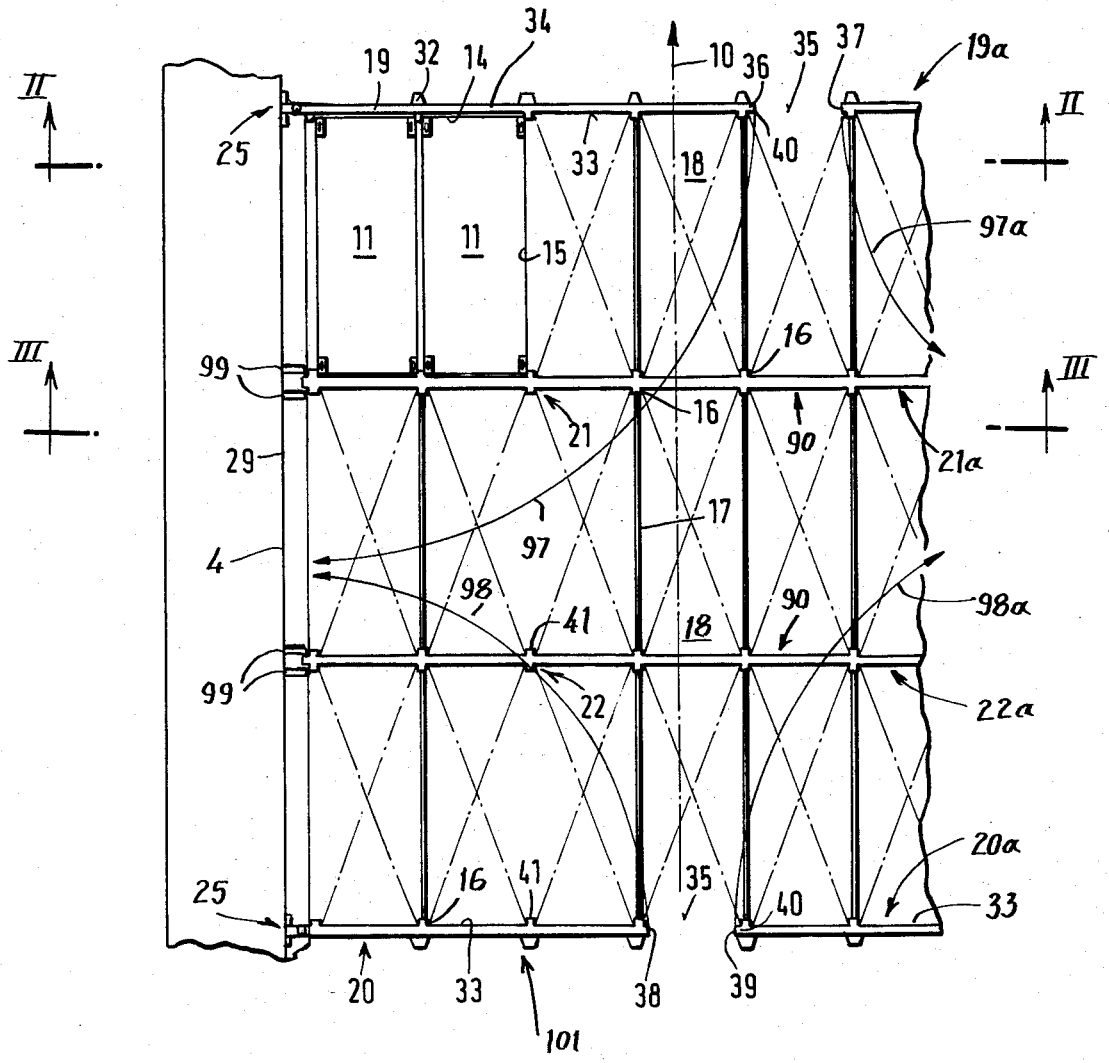
FIG. 1 is a partly plan view of a cargo compartment illustrating a system according to the invention for storing containers.
Figure 2:
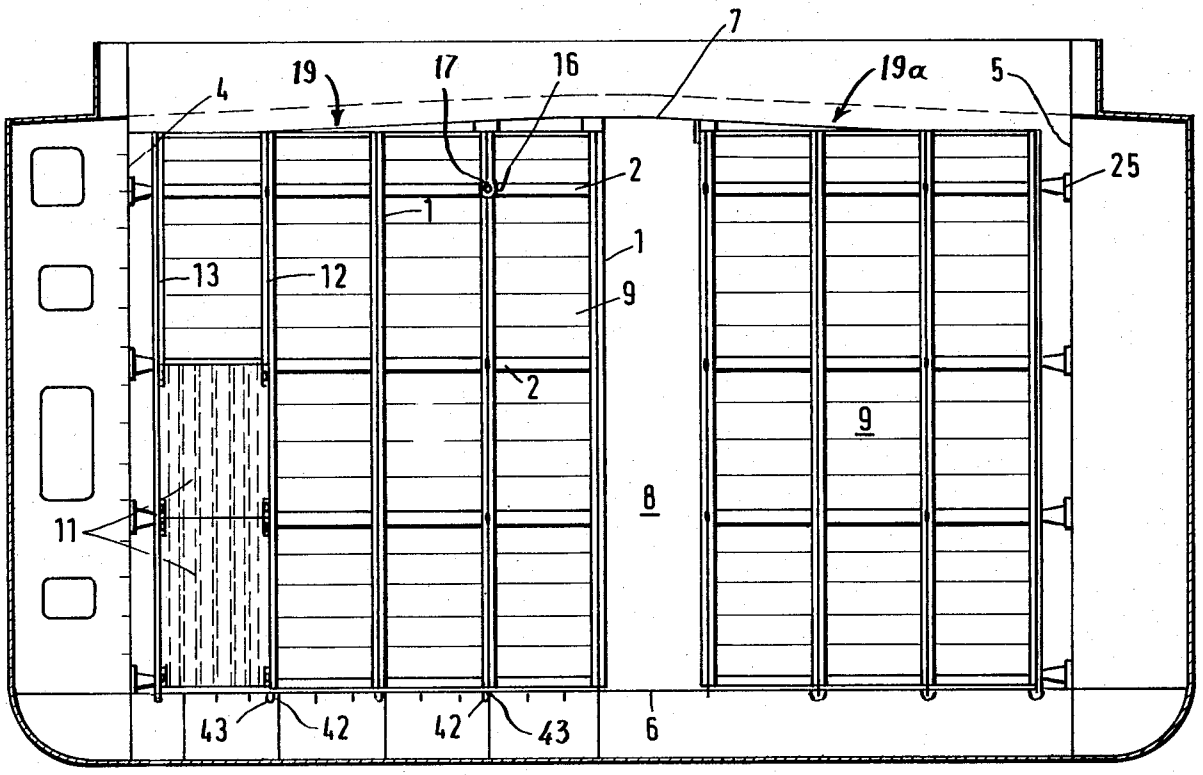
FIG. 2 is a sectional view in the direction of the arrows II—II of FIG. 1.

FIGS. 1 and 2 illustrate a cargo compartment 8 of large dimensions in a cargo carrier which is here assumed to be a ship. The cargo compartment 8 is located in the hull 3 of the ship and is bounded by a pair of lateral walls 4 and 5, a double-walled bottom 6 and an upper wall or deck 7. The walls 4 and 5 extend in the longitudinal direction of the ship and the cargo compartment 8. This direction is indicated by the arrow 10 in FIG. 1.

A pair of members 19 and 20 for confining containers 11 is mounted on the wall 4. The members 19 and 20 are pivotable from the operative positions shown in FIG. 1 to inoperative positions in which the members 19 and 20 are located adjacent to and extend in substantial parallelism with the wall 4. When the members 19 and 20 are in their operative positions, the members 19 and 20 serve to confine the containers 11 and the cargo compartment 8 is adapted for storage and transportation of the same. On the other hand, when the members 19 and 20 are in their inoperative positions, the cargo compartment 8 is adapted for the storage and transportation of bulk goods. The paths followed by the members 19 and 20 during movement between their operative and inoperative positions are respectively indicated by the arrows 97 and 98.

A second pair of members 19*a* and 20*a* for confining the containers 11 is mounted on the wall 5. Similarly to the members 19 and 20, the members 19*a* and 20*a* are pivotable between the operative positions shown in FIG. 1 and inoperative positions in which the members 19*a* and 20*a* are located adjacent the wall 5 and extend substantially parallel thereto. The paths followed by the members 19*a* and 20*a* during movement between their operative and inoperative positions are respectively indicated by the arrows 97*a* and 98*a*.

As illustrated in FIG. 2, each of the members 19, 19*a*, 20, 20*a* comprises a framework which includes crisscrossing, elongated elements such as columns or bars 1 and crossbars 2. The columns 1 and crossbars 2 are essentially perpendicular to one another. The columns 1 extend in the vertical direction of the ship or cargo container 8 while the crossbars 2 are generally horizontal. In the operative positions of the members 19, 19*a*, 20, 20*a*, the crossbars 2 extend transverse to the longitudinal direction 10 of the ship and the cargo compartment 8.

The columns 1 are spaced by slightly less than the width of the containers 11 and have abutment surfaces 12 which engage the end faces 14 of the containers 11 as well as abutment surfaces 13 which engage the side faces 15 of the containers 11. The crossbars 2 are separated from one another by approximately the height of the containers 11.

The columns 1 and crossbars 2 of each member 19, 19*a*, 20, 20*a* are connected by stiffening or reinforcing plates 9 which lie in the plane defined by the columns 1 and crossbars 2. The plates 9 are preferably welded to the columns 1 and the crossbars 2. The plates 9 are in the form of small rectangles having a high resistance to torsional stresses. In the illustrated embodiment, the plates 9 are arranged in such a manner that the longitudinal axes thereof are horizontal and extend transverse of the longitudinal direction 10 of the ship and the cargo compartment 8 when the members 19, 19*a*, 20, 20*a* are in their operative positions. However, it is also possible for the longitudinal axes of the plates 9 to extend vertically. The plates 9 are arranged over substantially the entire height of each of the members 19, 19*a*, 20, 20*a* and abut one another so that virtually no gaps exist in the members 19, 19*a*, 20, 20*a*.

As shown in FIG. 1, a pair of dividers 21 and 22 is mounted on the wall 4 between the members 19 and 20. Similarly, a pair of dividers 21*a* and 22*a* is mounted on the wall 5 between the members 19*a* and 20*a*. The dividers 21 and 21*a* are in alignment with one another as are the dividers 22 and 22*a*. Contrary to the members 19, 19*a*, 20, 20*a*, the dividers 21, 21*a*, 22, 22*a* are not pivotally mounted on the walls 4 and 5 but are fixedly and releasably connected thereto by means of suitable fastening elements 99. The length of each of the dividers 21 and 22 as measured in a direction transverse to the longitudinal direction 10 of the ship and the cargo compartment 8 is preferably smaller than the length of one or both of the members 19 and 20 bounding the same by at least one container width. Likewise, the length of each of the dividers 21*a* and 22*a* is preferably smaller than the length of one or both of the bounding members 19*a* and 20*a* by at least one container width.

The divider 21 is spaced from the member 19 as well as from the divider 22 by one container length, e.g. 20-feet, while the divider 22 is spaced from the member 20 by the same amount. In like manner, the divider 21*a* is spaced from the divider 22*a* and from the member 19*a* by one container length whereas the divider 22*a* and the member 20*a* are also spaced by one container length.

Figure 3:
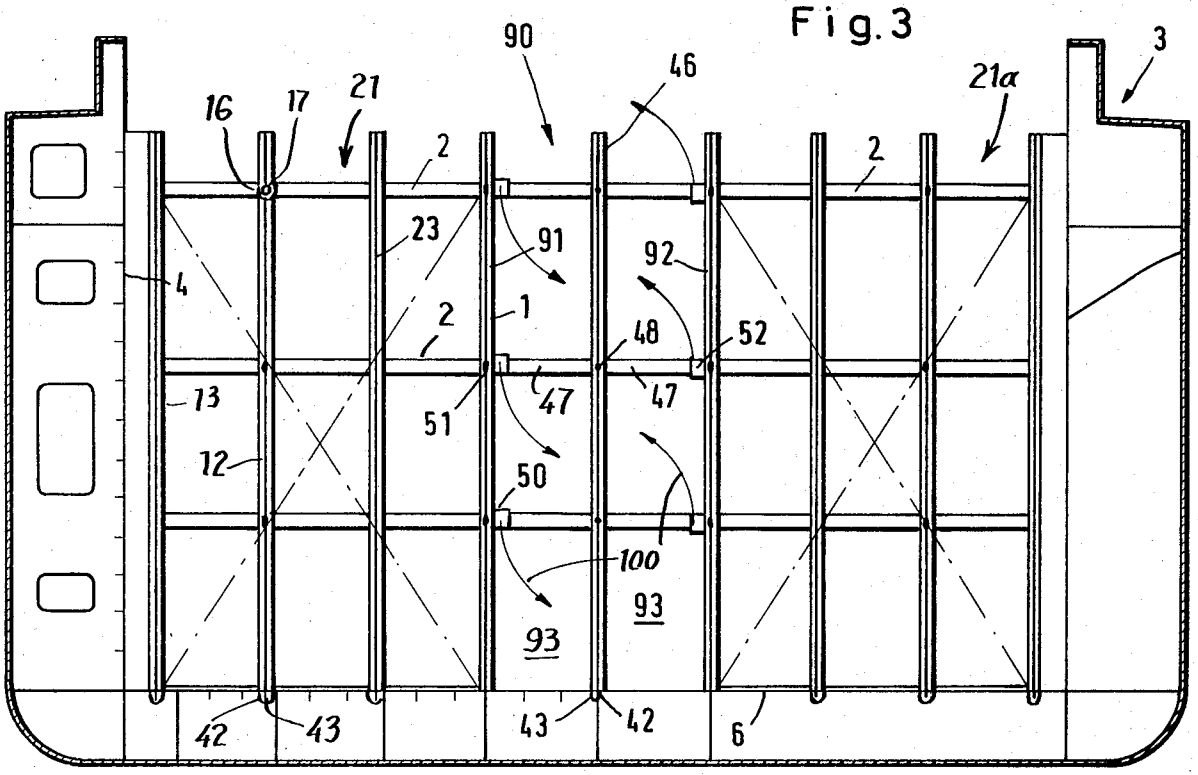
FIG. 3 is a sectional view in the direction of the arrows III—III of FIG. 1.

As shown in FIG. 3, the dividers 21, 21*a*, 22, 22*a* include a framework similar to that of the members 19, 19*a*, 20, 20*a*, mainly, a framework made up of the criss-crossing columns 1 and crossbars 2. The columns 1 of the dividers 21, 21*a*, 22, 22*a* again have abutment surfaces 12 for engaging the end faces 14 of the containers 11 and abutment surfaces 13 for engaging the side faces 15 of the containers 11.

The dividers 21 and 21*a*, as well as the dividers 22 and 22*a*, are connected with one another by means of discrete connecting elements 90. As seen in FIG. 3, the divider 21 has a terminal end 91 while the divider 21*a* has a terminal end 92. The terminal ends 91 and 92 define a gap 93 having a width which is approximately equal to twice the width of the containers 11. The dimensioning of the dividers 21 and 21*a* so as to leave a gap 93 of such width between the terminal ends 91 and 92 thereof makes it much simpler to install and remove the dividers 21 and 21*a* than if each of these extended to the center of the cargo compartment 8.

The connecting element 90 is located in the gap 93 and joins the terminal ends 91 and 92 of the dividers 21 and 21*a*. The connecting element 90 includes a spine or column 46 and ribs or bars 47. The ribs 47 are rotatably mounted on the spine 46 by means of pivots 48. The ribs 47 are rotatable between active positions in which these are aligned with respective ones of the crossbars 2 of the dividers 21 and 21*a* and inactive positions in which they are approximately parallel to the spine 46. The paths followed by the ribs 47 during movement from their active to their inactive positions are indicated by the arrows 100.

The ends 51 and 52 of the ribs 47 are in the form of abutments. The terminal ends 91 and 92 of the dividers 21 and 21*a* are provided with pockets 50 having recesses which accommodate the ends 51 and 52 of the ribs 47 when the latter are in their active positions. The pockets 50 are mounted on the columns 1 of the dividers 21 and 21*a* at approximately the levels of the crossbars 2. The pockets 50 which receive the ends 51 of the ribs 47 are downwardly open since the ends 51 enter and leave the corresponding pockets 50 from below. On the other hand, the pockets 50 which receive the ends 52 of the ribs 47 are upwardly open since the ends 52 enter and leave the corresponding pockets 50 from above.

The description of FIG. 3 applies, of course, to the dividers 22 and 22*a* as well as the dividers 21 and 21*a*.

The confining members 19 and 19*a* are aligned with one another in their operative positions as are the confining members 20 and 20*a*. In a system such as illustrated, that is, a system having two pairs 19, 19*a* and 20, 20*a* of pivotable, aligned confining members and two pairs 21, 21*a* and 22, 22*a* of aligned dividers, it is advantageous for the confining members 19 and 20 which are mounted on the common wall 4 to have different lengths. Similarly, it is advantageous for the confining members 19*a* and 20*a* mounted on the common wall 5 to have different lengths. The longer one of the members 19 and 20 mounted on the wall 4 is then arranged to be in alignment with the shorter one of the members 19*a* and 20*a* mounted on the wall 5 when the members 19, 19*a*, 20, 20*a* are in their operative positions. In the present case, the member 19 is the longer one of the pair of members 19 and 20 mounted on the wall 4 and is arranged to be aligned with the member 19*a* which is the shorter one of the pair of members 19*a* and 20*a* mounted on the wall 5. Such a design stiffens the entire system. Such a system still exhibits some degree of flexibility as is required but is nevertheless sufficiently strong to maintain the containers 11 in their desired positions.

The confining members 19, 19*a*, 20, 20*a* as well as the dividers 21, 21*a*, 22, 22*a*, are provided with supporting elements 16. The supporting elements 16 are mounted on the columns 1 at approximately the levels of the crossbars 2. Each of the confining members 19, 19*a*, 20, 20*a* has a face 33 which is directed towards one of the dividers 21, 21*a*, 22, 22*a* and the supporting elements 16 of the members 19, 19*a*, 20, 20*a* are mounted on the faces 33. On the other hand, each of the dividers 21, 21*a*, 22, 22*a* has supporting elements 16 mounted on two opposite faces thereof, mainly, the face which is directed towards one of the confining members 19, 19*a*, 20, 20*a* and the face which is directed towards a neighboring one of the dividers 21, 21*a*, 22, 22*a*. The connecting elements 90 which join the dividers 21, 21*a* and the dividers 22, 22*a* are provided with the supporting elements 16 in the same manner as the dividers 21, 21*a*, 22, 22*a*.

The supporting elements 16 serve to support stiffening or reinforcing elements 17 which extend in the longitudinal direction 10 of the ship and the cargo compartment 8. The stiffening elements 17, which reinforce the container storage system comprising the pivotable confining members 19, 19*a*, 20, 20*a* and the dividers 21, 21*a*, 22, 22*a*, provide connections between the dividers 21, 21*a* and 22, 22*a* as well as between the dividers 21, 21*a*, 22, 22*a* and the members 19, 19*a*, 20, 20*a*. In the event that the dividers 21, 21*a*, 22, 22*a* are omitted, the stiffening elements 17 would directly connect the confining members 19, 19*a* with the confining members 20, 20*a*. The stiffening elements 17 cooperate with the confining members 19, 19*a*, 20, 20*a* and the dividers 21, 21*a*, 22, 22*a* to define receiving spaces 18 for the containers 11. The stiffening elements 17 bound the receiving spaces 18 on the longitudinal sides thereof.

The stiffening elements 17 are advantageously in the form of tubes since these are easy to handle and may be reliably inserted in the supporting elements 16. The supporting elements 16 may, for example, be in the form of upwardly open semi-cylinders so that the stiffening elements 17 can be laid on the supporting elements 16 from above.

The stiffening elements 17 may be secured on the supporting elements 16 to prevent them from falling off. The stiffening elements 17 are preferably secured in such a manner that they are free to move in longitudinal direction thereof. This makes it possible for the container storage system to conform to deformations of the hull 3 even when the latter undergoes large deformations in heavy seas.

A container storage system designed in the manner described above has considerable strength and offers good resistance to distortion. Although the stiffening elements 17 and the manner of selecting the lengths of the confining members 19, 19*a*, 20, 20*a* contribute to the strength of the system, such strength is primarily due to the plates 9 which reinforce the members 19, 19*a*, 20, 20*a*. The strength of the system may be further enhanced by providing the members 19, 19*a*, 20, 20*a* with ribs 32 which extend over the height of the members 19, 19*a*, 20, 20*a* in vertical direction of the ship and the cargo compartment 8. In other words, the ribs 32 are substantially parallel to the columns 1. However, while the columns 1 are situated on those faces 33 of the members 19, 19*a*, 20, 20*a* which face the containers 11, the ribs 32 are situated on the opposite faces 34 of the confining members 19, 19*a*, 20, 20*a*. When the members 19, 19*a*, 20, 20*a* are in their inoperative positions, the faces 34 are directed towards the cargo compartment 8. The ribs 32 then function to increase the resistance of the members 19, 19*a*, 20, 20*a* against pressure which may be exerted by bulk goods loaded into the cargo compartment 8.

The ribs 32 advantageously have a four-sided cross section. Preferably, the ribs 32 taper inwardly and conically in a direction away from the faces 34.

As seen in FIG. 1, a gap 35 is defined between the terminal end 36 of the confining member 19 and the terminal end 37 of the aligned confining member 19*a* as well as between the terminal ends 38 and 39 of the aligned confining members 20 and 20*a*. The width of the gaps 35 approximates that of the containers 11. Thus, the space bounded by the gaps 35 at one end can serve to accommodate containers 11. In order to insure that the containers 11 in such spaces remain confined, the ends 36–39 of the confining members 19, 19*a*, 20, 20*a* are provided with extensions 40 which abut the end faces 14 of the containers 11 received in the corresponding spaces.

The confining members 19, 19*a*, 20, 20*a*, as well as the dividers 21, 21*a*, 22, 22*a*, may be constructed so that the pattern of the columns 1 is irregular in that one or more of the columns 1 is omitted at a location or locations where the presence of a column 1 is expected. Such a location is identified by the arrow 101 in FIG. 1. Neither the confining members 19, 20 nor the dividers 21, 22 are provided with columns 1 at the location 101. Instead, the members 19, 20 as well as the dividers 21, 22 are provided with guide elements 41. In the case of the confining members 19, 20, the guide elements 41 are situated on the faces 33 which are directed towards the conainers 11. On the other hand, the dividers 21, 22 have guide elements 41 both on those faces thereof which are directed towards one another and on the opposite faces which are directed towards the respective confining members 19, 20. The guide elements 41 extend over the height of the members 19, 20 and the dividers 21, 22 in vertical direction of the ship and the cargo compartment 8. As is the case for the columns 1, the guide elements 41 have abutment surfaces which engage the end faces 14 of the containers 11 and abutment surfaces which engage the side faces 15 of the containers 11. It is possible to dispense with the stiffening elements 17 at the location 101, that is, in the region of the guide elements 41.

Figure 6:
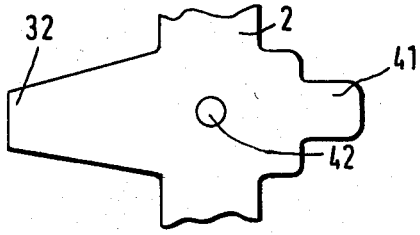
FIG. 6 is a plan view of the arresting arrangement of FIG. 5.

FIGS. 2 and 3 show that the confining members 19, 19*a*, 20, 20*a* and the dividers 21, 21*a*, 22, 22*a* are provided with arresting elements or bolts 42. The bolts 42 are mounted on the lowermost crossbars 2 and are in alignment with the columns 1. Where the columns 1 are omitted as at the location 101 in FIG. 1, the bolts 42 are advantageously located in the regions of the intersections between the lowermost crossbars 2 and the guide elements 41. This is illustrated in FIG. 6 for one of the confining members 19, 20. For the confining members 19, 20, the intersection of a lowermost crossbar 2 with a guide element 41 corresponds to the intersection of such crossbar 2 with a rib 32. The bolts 42 are movable between released positions and locked positions. In the locked positions, the lower ends of the bolts 42 are received in recesses 43 provided in the bottom wall 6 of the hull 3. As a result, the confining members 19, 19*a*, 20, 20*a* and the dividers 21, 21*a*, 22, 22*a* are fixed relative to the bottom wall 6. In the released positions, the lower end faces of the bolts 42 are flush with the lower surfaces of the lowermost crossbars 2.

Figure 4:
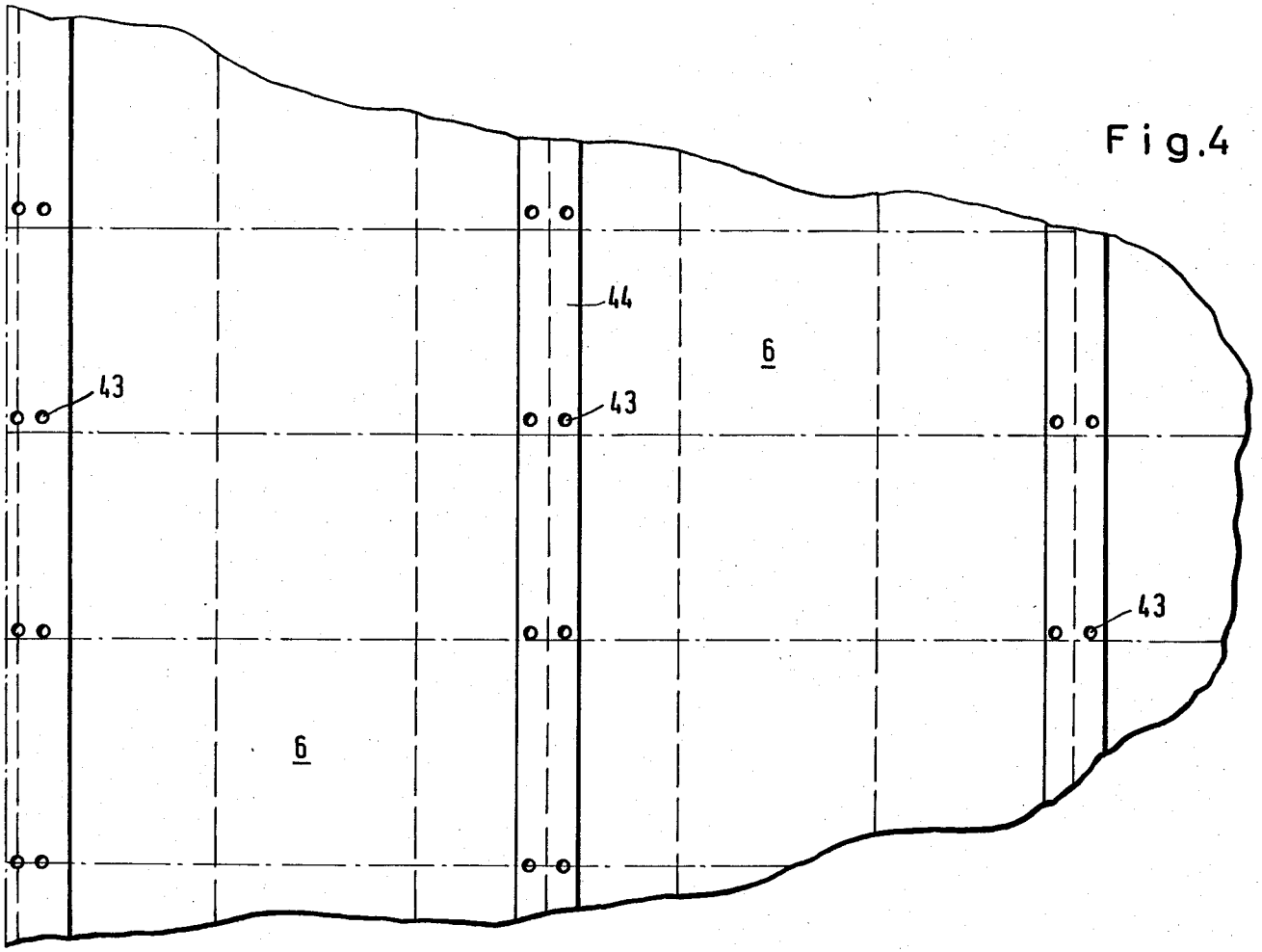
FIG. 4 is a plan view of the bottom of the cargo compartment of FIG. 1.

In order to prevent weakening of the bottom wall 6 by the recesses 43, the bottom wall 6 is provided with reinforcements 44 as illustrated in FIG. 4. The reinforcements 44 extend transversely of the longitudinal direction 10 of the ship and the cargo compartment 8.

Figure 5:
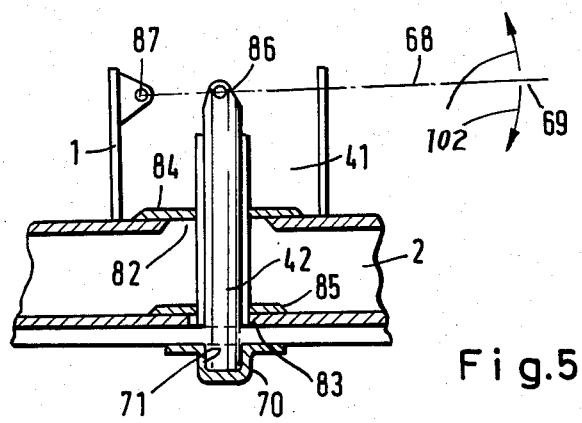
FIG. 5 is a sectional elevational view of an arrangement for arresting the system of FIG. 1.

FIG. 5 shows that the bolts 42 extend through the lowermost crossbars 2. To this end, the lowermost crossbars 2, which are here assumed to be tubular, are provided with upper openings 82 and lower openings 83 in the regions of the bolts 42. Guides 84 are mounted adjacent the upper openings 82 whereas guides 85 are mounted adjacent the lower openings 83 and the bolts 42 are movably mounted in the guides 84 and 85.

In order to facilitate displacement of the bolts 42 between their released and locked positions, the upper end 86 of each of the bolts 42 is advantageously connected with a lever 68 which is rotatably mounted on a pivot 87. The pivot 87 is favorably supported on either a rib 32 or a guide element 41. The end of the lever 68 remote from the pivot 87 is provided with a handle 69. Movement of the lever 68 in the manner indicated by the arrows 102 enables the corresponding bolt or bolts 42 to be readily lowered into the recesses 43 and raised therefrom. As noted previously, the lower end faces of the bolts 42 are flush with the lower surfaces of the lowermost bars 2 in the released positions thereof. Each of the confining members 19, 19*a*, 20, 20*a*, as well as each of the dividers 21, 21*a*, 22, 22*a*, may be provided with the lever arrangement of FIG. 5.

Each of the connecting elements 90 is also provided with a bolt 42 which is adapted to be received in a recess 43 so as to maintain the connecting element 90 in position. The bolts 42 of the connecting elements 90 are mounted at the lower ends of the spines 46 and need not be movable.

Figure 7:
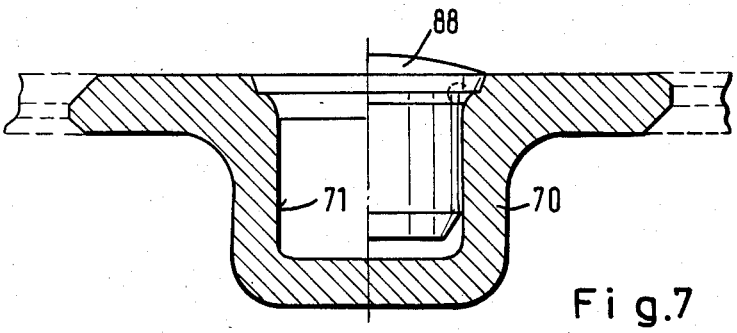
FIG. 7 is a sectional elevational view illustrating part of the arresting arrangement of FIG. 5 on a larger scale.

Referring to FIGS. 5 and 7, the recesses 43 are formed in pockets 70 which are mounted in the reinforcements 44 of the bottom wall 6. The pockets 70 are in the form of cup-shaped inserts and are welded to the bottom wall 6. The pockets 70 have a generally U-shaped cross section and the inner surfaces 71 thereof which bound the recesses 43 are designed to engage and guide the bolts 42. Advantageously, the pockets 70 are made from steel castings. As best seen in FIG. 7, the pockets 70 may be closed by stoppers 88 when they are not in use. The stoppers 88 prevent dirt from entering the pockets 70. The tops of the stoppers 88 are shaped like lenses and project above the bottom wall 6 when the stoppers 88 are received in the pockets 70. This design permits the stoppers 88 to be readily removed from the pockets 70, on the one hand, and does not substantially affect the continuity of the bottom wall 6, on the other hand.

Figure 8:
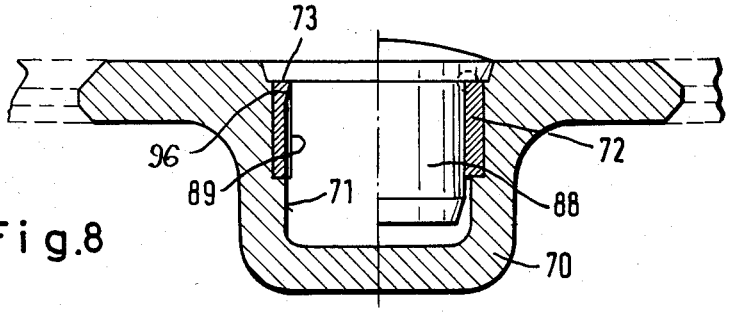
FIG. 8 is similar to FIG. 7 but illustrates a different embodiment.

As shown in FIG. 8, sleeves 72 may be mounted on the inner surfaces 71 of the pockets 70. The sleeves 72 may be composed of a material having a low coefficient of friction in order to facilitate introduction of the bolts 42 and the stoppers 88 into, as well as removal of the bolts 42 and the stoppers 88 from, the pockets 70.

Movement of the bolts 42 and stoppers 88 into and out of the pockets 70 may be further facilitated by providing the sleeves 72 with reliefs 89 so that collars 96 are formed at the upper ends 73 of the sleeves 72. The reliefs 89 are dimensioned so that the corresponding surfaces of the sleeves 72 are free of contact with the bolts 42 and the stoppers 88 while the collars 96 are dimensioned to engage the bolts 42 and the stoppers 88. The effect of the reliefs 89 is to reduce the contact areas between the sleeves 72 and the bolts 42 or stoppers 88. This, in turn, reduces the chances that the bolts 42 and stoppers 88 will become inseparable from the sleeves 72 due to rusting.

With reference to FIGS. 1, 2, 9 and 10, each of the confining members 19, 19*a*, 20, 20*a* is mounted on the respective wall 4 and 5 via a series of vertically spaced hinges 25. The hinges 25 for each of the confining members 19, 19*a*, 20, 20*a* are separated from one another by a distance which does not exceed the spacing between neighboring ones of the crossbars 2. As illustrated in FIG. 2, the hinges 25 are here spaced by a distance which substantially equals the spacing between neighboring ones of the crossbars 2.

Figure 9:
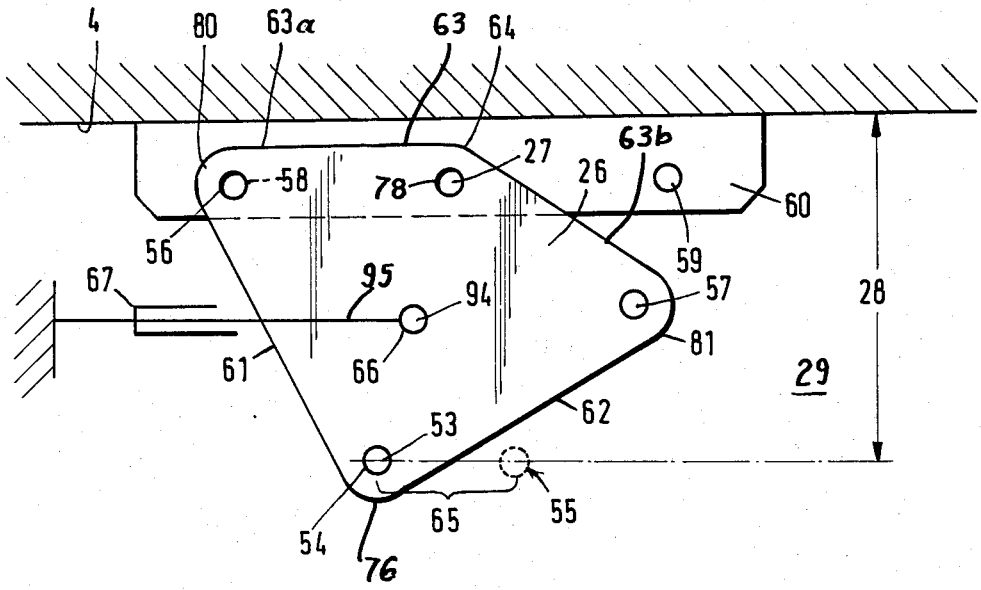
FIG. 9 is a plan view of a hinge for the system of FIG. 1.
Figure 10:
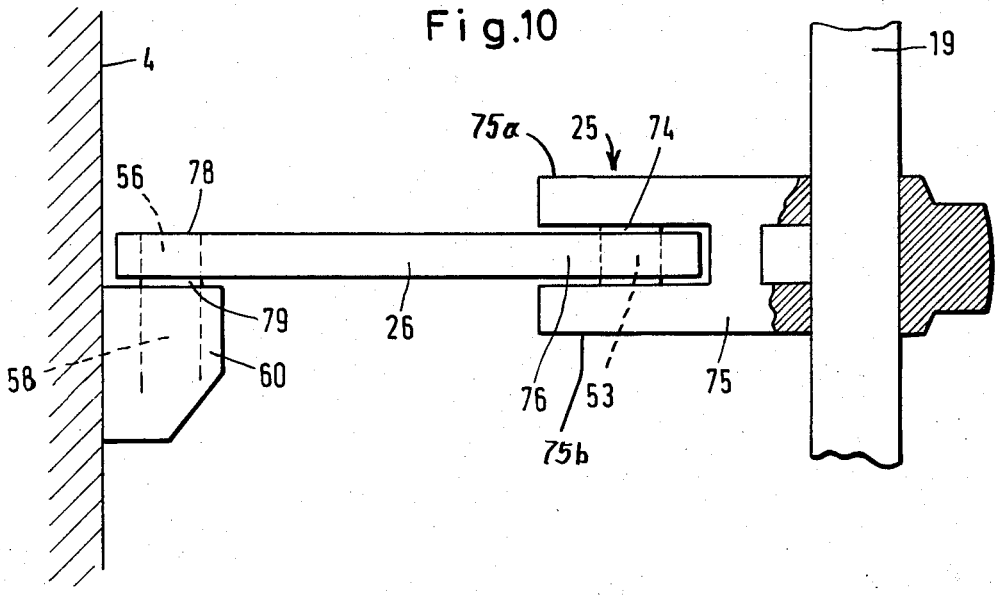
FIG. 10 is a side view of the hinge of FIG. 9.

FIGS. 9 and 10 show the details of one of the hinges 25 for the confining member 19. The hinge 25 includes a mounting element or plate 26 which is rotatable in a horizontal plane on a pivot 27 supported by the wall 4. As will become clearer below, the mounting plate 26 enables the confining member 19 to be displaced parallel to itself, that is, in the longitudinal direction 10 of the ship and the cargo compartment 8, when the confining member 19 is in its operative position. The mounting plate 26 makes it possible to shift the confining member 19 by a distance 65 which is required to adapt the container storage system to containers 11 of different length. For example, the length of two 20-foot containers 11 placed end-to-end is less than that of a 40-foot container. The distance 65 may be selected in such a manner as to compensate for this length differential.

The mounting plate 26 is generally in the form of an equilateral triangle having sides 61, 62 and 63. For reasons which will become apparent, the side 63 has a convexity or protuberance 64 at the midpoint thereof which divides the side 63 into a pair of segments 63*a* and 63*b*. The side 63 is located in the region of the wall 4 and the pivot 27 on which the mounting plate 26 rotates is situated adjacent the protuberance 64. The pivot 27 is received in an opening 78 of the mounting plate 26.

The confining member 19 is fixedly secured to an approximately U-shaped hinge element 75 having a pair of spaced legs 75*a* and 75*b*. An apex 76 of the mounting plate 26 is received between the legs 75*a* and 75*b*. The apex 76, which is defined by the sides 61 and 62 and is remote from the sides 63 and the wall 4, is provided within an opening 53. The opening 53 receives a pivot or bolt 74 which is affixed to the legs 75*a* and 75*b* of the hinge element 75.

The pivot 27 is mounted in a bearing element or plate 60 which is secured to the wall 4. The bearing plate 60 is advantageously a steel plate and is preferably oriented horizontally. The bearing plate 60 is provided with a pair of openings 58 and 59. The openings 58 and 59 are located on opposite sides of and equidistant from the pivot 27.

The mounting plate 26 has a pair of apices 80 and 81 which are located in the region of the bearing plate 60. The apex 80 is defined by the sides 61 and 63 of the mounting plate 26 while the apex 81 is defined by the sides 62 and 63. The apex 80 is provided within an opening 56 whereas the apex 81 is provided with an opening 57. The openings 56 and 57 are located on opposite sides of and are equidistant from the pivot 27. The opening 56 and pivot 27 define a line paralleling the segment 63*a* of the side 63 while the opening 57 and the pivot 27 define a line paralleling the segment 63*b*.

The mounting plate 26 may be rotated on the pivot 27 between a terminal position in which the opening 56 thereof is aligned with the opening 58 in the bearing plate 60 and another terminal position in which the opening 57 thereof is aligned with the opening 59 in the bearing plate 60. FIGS. 9 and 10 illustrate the former of these two terminal positions. The mounting plate 26 may be fixed in its terminal positions by means of a bolt 79 which is received in the aligned openings 56, 58 or 57, 59.

The mounting plate 26 has a center of gravity 94 approximately midway between the pivot 27 and the opening 53. A prime mover 67 for rotating the mounting plate 26 on the pivot 27 is connected with the mounting plate 26 at the center of gravity 94 thereof via a link 95. Advantageously, a bearing 66 is mounted on a mounting plate 26 at its center of gravity 94 and the link 95 then engages the bearing 66. The prime mover 67 may, for example, be a hydraulically or pneumatically operated piston-and-cylinder unit. The link 95 may then be a piston rod. It is also possible for the prime mover 67 to be an electrically operated mechanism.

The prime mover 67 may engage the mounting plate 26 at locations other than the center of gravity 94. In this regard, it is to be recalled that the power requirements will vary as the point of engagement between the prime mover 67 and the mounting plate 26 changes.

As mentioned previously, the side 63 of the mounting plate 26 is provided with a protuberance 64 and the pivot 27 for the mounting plate 26 is located in the region of the protuberance 64. The protuberance 64 enables the pivot 27 to be located further away from the center of gravity 94 of the mounting plate 26 than would be the case if the side 63 of the mounting plate 26 were linear. In this connection, it will be observed that the openings 56 and 57 of the mounting plate 26 define a line which is the linear equivalent of the side 63. This line constitutes the base of an isosceles triangle which has sides of equal length defined by the opening 56 and the pivot 27, on the one hand, and the opening 57 and the pivot 27, on the other hand. The pivot 27, which lies on an apex of this isosceles triangle, is located on the side of the base remote from the center of gravity 94 of the mounting plate 26. In the absence of the protuberance 64, it would be necessary for the pivot 27 to be located on the opposite side of the base and hence nearer the center of gravity 94. The moment arm for rotation of the mounting plate 26 would then be reduced thereby causing a corresponding increase in the force required to move the mounting plate 26.

The opening 53 of the mounting plate 26 has a terminal position 54 which corresponds to that terminal position of the mounting plate 26 in which the opening 56 thereof is aligned with the opening 58 in the bearing plate 60. The opening 53 has a second terminal position 55 which is occupies when the opening 57 of the mounting plate 26 is aligned with the opening 59 in the bearing plate 60. The terminal positions 54 and 55 of the opening 53 lie on an imaginary line which parallels the longitudinal direction of the generally planar wall 4. The terminal positions 54 and 55 are spaced by the distance 65 which is necessary to compensate for the length differential between containers 11 of different length. Since the arrangement is such that the mounting plate 26 need be rotated through only a relatively small angle in order for the opening 53 to move from the terminal position 54 to the terminal position 55 and vice versa, the protuberance 64 subtends a relatively large obtuse angle or, in other words, the segments 63*a* and 63*b* of the side 63 of the mounting plate 26 define a relatively large obtuse angle.

As just mentioned, the terminal positions 54 and 55 of the opening 53 lie on an imaginary line paralleling the longitudinal direction of the generally planar wall 4. Accordingly, the distance between the opening 53 and the wall 4 is the same in the terminal position 54 as in the terminal position 55. This distance is indicated by the reference numeral 28. It follows that the distance between the confining member 19 and the wall 4 is the same in the terminal position 54 as in the terminal position 55.

If the confining member 19 has the same orientation before and after movement of the opening 53 from one of the terminal positions 54 and 55 to the other, the confining member 19 has, in effect, undergone a displacement parallel to itself. This is made possible by the special geometry of the mounting plate 26. This geometry results from the fact that the pivot 27 and the opening 53 define a common side of a pair of isosceles triangles each of which has a second side equal in length to the common side. The second side of one of these triangles is defined by the opening 53 and the opening 56 while the second side of the other of the triangles is defined by the opening 53 and the opening 57. The two triangles are mirror images of one another about their common side. This leads to the condition that the distance between the pivot 27 and the opening 58 in the bearing plate 60 equals the distance between the pivot 27 and the opening 59 in the bearing plate 60. The shape which is derived for the mounting plate 26 from the considerations just set forth is a generally equilateral triangle having a side 61 which parallels the imaginary line defined by the openings 53 and 56 and a side 62 which parallels the imaginary line defined by the openings 53 and 57. The third side of the equilateral triangle is the side 63 which extends generally in the direction of the imaginary line defined by the openings 56 and 57 but is not parallel to this line due to the presence of the protuberance 64 for the reasons explained earlier.

The terminal positions 54 and 55 of the opening 53 are arranged in such a manner that the distance between the terminal position 54 and the pivot 27 equals the distance between the terminal position 55 and the pivot 27. Thus, the terminal positions 54 and 55 and the pivot 27 are located at the apices of an isosceles triangle having a base which is defined by the terminal positions 54 and 55 and a pair of sides of equal length defined by the pivot 27 and the terminal position 54, on the one hand, and the pivot 27 and the terminal position 55, on the other hand.

As mentioned previously, the opening 53 is spaced from the wall 4 by the distance 28 when the opening 53 is in either of the terminal positions 54 and 55. The distance 28 represents the distance of closest approach of the opening 53 to the wall 4 or, in other words, represents the minimum spacing between the opening 53 and the wall 4. The distance 28 corresponds to the width of a space 29 which may be used to store the dividers 21, 21*a*, 22, 22*a* when these are disconnected from the walls 4 and 5 in order to convert the cargo compartment 8 for the transportation of bulk goods rather than the containers 11. The space 29 may also be used to store other elements of the container storage system such as the stiffening elements 17 and the connecting elements 90 for the dividers 21, 21*a*, 22, 22*a*. The distance 28 is selected in such a manner that the space 29 is sufficiently large to accommodate the dividers 21, 21*a*, 22, 22*a*, the connecting elements 90, the stiffening elements 17 and any other elements of the container storage system. The elements of the container storage system are loaded into the storage space 29 and the open side of the storage space 29, which is separated from the wall 4 by the distance 28, is then closed by rotating the confining member 19 to its inoperative position. In this position, the confining member 19 is generally parallel to the wall 4. When the confining member 19 is in its inoperative position, the storage space 29 is bounded on one side by the wall 4 and on the opposite side by the confining member 19.

As just outlined, the distance 28 between the wall 4 and the opening 53 of the plate 26 functions to define the storage space 29 for the elements of the container storage system. Another important function of the distance 28 is to enable the confining member 19 to be freely rotated.

When the confining members 19, 19*a*, 20, 20*a* are in their inoperative positions and extend parallel to the walls 4 and 5, the cargo compartment 8 is configurated for the transportation of bulk goods. In order to convert the cargo compartment 8 for the transportation of the containers 11, the confining members 19, 19*a*, 20, 20*a* are pivoted to their operative positions so that they extend normal to or transversely of the longitudinal direction 10 of the ship and the cargo compartment 8. This may be achieved, for example, by gripping the terminal ends 36–39 of the confining members 19, 19*a*, 20, 20*a* with a crane and then raising the confining members 19, 19*a*, 20, 20*a* and rotating these in a raised position. Another possibility is to use a forklift truck instead of a crane for this purpose. It is also possible to mount the confining members 19, 19*a*, 20, 20*a* on wheels or rollers. When the confining members 19, 19*a*, 20, 20*a* are in their operative positions, the levers 68 are actuated to lower the bolts 42 into the recesses 43 provided in the bottom wall 6 of the hull 3.

The dividers 21, 21*a*, 22, 22*a*, as well as the other elements of the container storage system, may now be removed from the storage space 29. This may be accomplished by means of a crane, for example. However, any other suitable transporting device may be used for this purpose. The dividers 21, 21*a*, 22, 22*a* are secured to the walls 4 and 5 by means of the fastening elements 99 so that they extend normal to or transversely of the longitudinal direction 10 of the ship and the cargo compartment 8. The dividers 21, 21*a*, 22, 22*a* are mounted on the walls 4 and 5 in such a manner that they are spaced from the respective confining members 19, 19*a*, 20, 20*a* by a distance equal to the length of a container 11. Similarly, the dividers 21 and 21*a* are positioned at a distance of one container length from the dividers 22 and 22*a*. Once the dividers 21, 21*a*, 22, 22*a* are in position, the levers 68 of the dividers 21, 21*a*, 22, 22*a* are actuated to lower the corresponding bolts 42 into the matching recesses 43 formed in the bottom wall 6. The connecting elements 90 are now placed between the two pairs of dividers 21, 21*a* and 22, 22*a* so that the bolts 42 on the spines 46 are received in the appropriate recesses 43. At this time, the ribs 47 are in their inactive positions, that is, the ribs 47 extend parallel to the spines 46. Once the connecting elements 90 have been properly positioned, the ribs 47 are rotated to their active positions in which they are aligned with the respective crossbars 2 of the dividers 21, 21*a*, 22, 22*a*. In the active positions of the ribs 47, the ends 51 and 52 thereof are securely engaged by the pockets 50 mounted on the dividers 21, 21*a*, 22, 22*a* so that the ribs 47 are arrested by the pockets 50.

When the dividers 21 and 21*a*, as well as the dividers 22 and 22*a*, have been joined to one another by the connecting elements 90, the confining members 19, 19*a*, 20, 20*a* are connected with the dividers 21, 21*a*, 22, 22*a* and the connecting elements 90 via the stiffening elements 17. The latter are placed in the supporting elements 16 and then secured thereto. The confining members 19, 19*a*, 20, 20*a* now cooperate with the dividers 21, 21*a*, 22, 22*a* and with the connecting elements 90 to define a storage system for the containers 11.

By way of example, two pairs 19, 19*a* and 20, 20*a* of aligned confining members may be used to form a container storage system having a length sufficient to accommodate a row of three 20-foot containers 11 laid end-to-end. To this end, and as already explained above, two pairs 21, 21*a* and 22, 22*a* of aligned dividers are arranged between the pairs 19, 19*a* and 20, 20*a* of confining members in such a manner that the pairs 21, 21*a* and 22, 22*a* of dividers are spaced from one another by one container length of 20 feet while each pair 21, 21*a* and 22, 22*a* of dividers is spaced from the respective neighboring pair 19, 19*a* and 20, 20*a* of confining members by the same amount. An array of 20-foot containers 11 may thus be arranged lengthwise between the pair 19, 19*a* of confining members and the pair 21, 21*a* of dividers, between the pair 20, 20*a* of confining members and the pair 22, 22*a* of dividers and between the latter and the pair 21, 21*a* of dividers. The container storage system is accordingly configurated to receive rows of three 20-foot containers 11 arranged end-to-end. Eight such containers 11, for example, may be arranged side-by-side across the width of the container storage system.

In order to convert the container storage system for the transportation of 40-foot containers 11, at least one of the pairs 21, 21*a* and 22, 22*a* of dividers is removed. This is accomplished using the reverse of the procedure outlined earlier for the erection of the dividers 21, 21*a*, 22, 22*a*. Subsequently, one of the pairs 19, 19*a* and 20, 20*a* of confining members is displced in the longitudinal direction 10 of the ship and the cargo compartment 8 with the aid of the mounting plates 26. The pair 19, 19*a* or 20, 20*a* of confining members to be moved is determined by which of the pairs 21, 21*a* and 22, 22*a* of dividers has been removed. The pair 19, 19*a* or 20, 20*a* of confining members to be moved is that which is spaced from the remaining pair 21, 21*a* or 22, 22*a* of the dividers by two container lengths. Displacement of the confining members 19, 19*a* or 20, 20*a* is achieved by operating the appropriate levers 68 so as to withdraw the bolts 42 from the recesses 43 in the bottom wall 6 of the hull 3. When the confining members 19, 19*a*, 20, 20*a* are in their operative positions and the bolts 42 thereof are received in the recesses 43, withdrawal of the bolts 42 from the recesses 43 is a prerequisite to movement of the confining members 19, 19*a*, 20, 20*a*. The bolts 79 which arrest the mounting plates 26 in their terminal positions are removed. The prime mover 67 is then operated to rotate the mounting plates 26 on the pivots 27 from the terminal positions previously occupied to the other terminal positions thereof. Since, as indicated previously, the overall length of two 20-foot containers 11 arranged end-to-end is smaller than the length of a 40-foot container by the distance 65, the pair 19, 19*a* or 20, 20*a* of confining members to be moved is displaced away from the remaining pair 21, 21*a* or 22, 22*a* of dividers. The spacing between the displaced pair 19, 19*a* or 20, 20*a* of confining members and the remaining pair 21, 21*a* or 22, 22*a* of dividers is thus increased to such an extent that the end faces of a 40-foot container accommodated between the displaced pair 19, 19*a* or 20, 20*a* of confining members and the remaining pair 21, 21*a* or 22, 22*a* of dividers are respectively guided by the displaced pair 19, 19*a* or 20, 20*a* of confining members and the remaining pair 21, 21*a* or 22, 22*a* of dividers. After the mounting plates 26 have been rotated to their new terminal positions, the bolts 79 for arresting the mounting plates 26 are reinserted and the levers 68 are operated to depress the bolts 42 into the recesses 43.

In a container storage system comprising two pairs 19, 19*a* and 20, 20*a* of confining members and two pairs 21, 21*a* and 22, 22*a* of dividers, the distance 65 is equal to four times the difference between the length of a 40-foot container 11 and the overall length of a pair of 20-foot containers 11 arranged end-to-end.

Instead of the mounting plates 26 which extend transversely of the longitudinal axes of the columns 1, that is, transversely of the vertical axis of the ship and the cargo compartment 8, it is possible to use mounting plates which parallel the vertical axis of the ship and the cargo compartment 8. Such mounting plates may be welded to the crossbars 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A cargo carrier, particularly an oceangoing vessel, comprising means defining a cargo compartment and including at least one wall; a mounting plate pivotally mounted on said one wall and being movable between a pair of terminal positions; at least one member for confining containers which are accommodated in said compartment, said member being pivotally mounted on said plate for movement between an operative position in which said member is arranged to confine containers and an inoperative position in the region of said one wall; and a bearing element mounted on said one wall and having a pair of arresting recesses, said plate having a pair of arresting openings which are respectively aligned with said arresting recesses in said terminal positions to permit said plate to be arrested in said terminal positions, said bearing element having a pivot for said plate at approximately the midpoint thereof and said arresting recesses being located at the opposite sides of and being approximately equidistant from said pivot.

2. A cargo carrier, particularly an oceangoing cargo vessel, comprising means defining a cargo compartment and including at least one wall; a mounting plate pivotally mounted on said one wall and being movable between a pair of terminal positions; at least one member for confining containers which are accommodated in said compartment, said member being pivotally mounted on said plate for movement between an operative position in which said member is arranged to confine containers and an inoperative position in the region of said one wall; a bearing element mounted on said one wall and having a pair of arresting recesses, said plate having a pair of arresting openings which are respectively aligned with said arresting recesses in said terminal positions to permit said plate to be arrested in said terminal positions; a first pivot provided on said bearing element for said plate; and a second pivot provided on said plate for said member, said pivots defining a common side of a pair of triangles each of which has another side which is substantially equal in length to said common side and is defined by said second pivot and a respective one of said arresting openings, each of said triangles having an additional side defined by said first pivot and the respective arresting opening.

3. A cargo carrier, particularly an oceangoing cargo vessel, comprising means defining a cargo compartment and including a first and a second wall, said walls being spaced apart from one another; two members for confining containers which are accommodated in said compartment, said members being mounted on said first wall for movement between operative positions in which said members are arranged to confine containers and inoperative positions in the region of said first wall, said members being spaced by at least twice the length of a container when such members are in said operative positions; a first divider; means for releasably securing said divider to said first wall at a location intermediate said members when said members are in said operative positions; a second divider, each of said dividers including substantially horizontal bars; means for releasably securing said second divider to said second wall so that said dividers are substantially in alignment; and means for connecting said dividers with one another, including a spine and a plurality of ribs pivotally mounted on said spine, said ribs being movable between non-aligned positions and aligned positions in which each of said ribs is in alignment with and joins a bar of one divider with a bar of the other divider.

4. A carrier as defined in claim 3, wherein the bars of each divider have ends which face the bars of the other divider and said ends are provided with recesses which receive said ribs in said aligned positions.

* * * * *